United States Patent [19]

Takahashi et al.

[11] Patent Number: 4,533,622

[45] Date of Patent: Aug. 6, 1985

[54] PHOTOGRAPHIC ELEMENT FOR COLOR DIFFUSION TRANSFER PROCESS CONTAINING HYDROQUINONE SULFONATES

[75] Inventors: Osamu Takahashi; Mitsugu Tanaka, both of Kanagawa, Japan

[73] Assignee: Fuji Photo Film Co., Ltd., Kanagawa, Japan

[21] Appl. No.: 598,099

[22] Filed: Apr. 9, 1984

[30] Foreign Application Priority Data

Apr. 7, 1983 [JP] Japan ..... 58-61287

[51] Int. Cl.[3] ..... G03C 1/40; G03C 51/54

[52] U.S. Cl. ..... 430/218; 430/485

[58] Field of Search ..... 430/218, 559, 566, 485

[56] References Cited

U.S. PATENT DOCUMENTS 3,227,552 1/1966 Whitmore ..... 430/218

4,429,031 1/1984 Tsubota et al. ..... 430/218

OTHER PUBLICATIONS

"Photographic Processes and Products", *Research Disclosure,* No. 15162, 11/1976, pp. 76–87.

*Primary Examiner*—Richard L. Schilling

*Attorney, Agent, or Firm*—Sughrue, Mion, Zinn, Macpeak, and Seas

[57] ABSTRACT

A photographic element for a color diffusion transfer process comprising a support having thereon at least one silver halide emulsion layer and associated therewith a non-diffusible redox compound capable of releasing a diffusible dye or a precursor thereof as the result of treatment with an alkaline processing solution in the presence of a silver halide developing agent after exposure to light, the alkaline processing solution containing a compound represented by the following general formula (I):

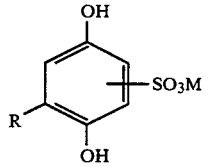

(I)

wherein R represents an alkyl group, an alkoxy group, an aromatic group or an alkylthio group, and each of these groups has 12 or less carbon atoms; and M represents a cation.

13 Claims, No Drawings

PHOTOGRAPHIC ELEMENT FOR COLOR DIFFUSION TRANSFER PROCESS CONTAINING HYDROQUINONE SULFONATES

FIELD OF THE INVENTION

The present invention relates to a photographic element for color diffusion transfer process and, more particularly, to a processing solution for a color diffusion transfer process and a photographic element which has this processing solution associated therewith.

BACKGROUND OF THE INVENTION

In photographic elements for color diffusion transfer processes using dye-releasing redox compounds capable of releasing diffusible dyes as the result of the redox reaction with oxidation products of developing agents produced by the development of silver halides (such compounds are called "DRR compounds" hereinafter), the silver halide developing agents are either added to alkaline processing compositions or incorporated into the photographic elements in the form of their respective precursors. Representative silver halide developing agents suitable therefor are 3-pyrazolidinone type compounds and aminophenol type compounds. In addition to silver halide developing agents, certain alkali-soluble hydroquinones may be further added to the alkaline processing compositions as a competitive developing agent for the purpose of competing with the redox reaction of the oxidation products of developing agent with DRR compounds, as described in *Research Disclosure,* No. 15162, p. 79 (November, 1976).

In the present specification, the term "competitive developing agent" refers to a compound having a gradation controlling effect.

*Research Disclosure,* supra, discloses that hydroquinone, methylhydroquinone and t-butylhydroquinone are especially effective as a competitive developing agent. On the other hand, Japanese Patent Application (OPI) No. 51741/81 (the term "OPI" as used herein refers to a "published unexamined Japanese patent application") discloses that certain dialkylhydroquinones are added as a competitive agent to an alkaline processing composition. Those hydroquinones, although they may have their respective gradation controlling effects as described therein, suffer from the following serious disadvantages.

That is, unsubstituted hydroquinone has little effect on gradation control, while mono- or dialkylhydroquinones in alkaline processing compositions containing them have the difficulties that (1) the processing capacity is greatly changed with the lapse of time, (2) the so-called mottle is generated upon development-processing, and so on. In particular, phenomenon (2) tends to occur with greater probability the higher the viscosity of the developing composition containing a thickener such as carboxymethyl cellulose in a greater amount.

SUMMARY OF THE INVENTION

Therefore, a primary object of the present invention is to provide a photographic element for a color diffusion transfer process which is employed in association with a developing solution capable of improving the variation of photographic characteristics (especially, $D_{max}$) with the lapse of time and hardly generating mottle upon development-processing.

The above-described object of the present invention is attained by incorporating the compound represented by the following general formula (I) in an alkaline processing composition which is to be used in association with a photographic element comprising a support having thereon at least one silver halide emulsion layer which has associated therewith a nondiffusible redox compound capable of releasing a diffusible dye or a precursor thereof as the result of a treatment with an alkaline processing solution in the presence of a silver halide developing agent after exposure to light (which diffusible dye diffuses into an image-receiving layer and forms a transfer image therein);

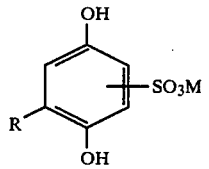

(I)

wherein R represents an alkyl group, an alkoxy group, an aromatic group or an alkylthio group, and each of these groups has 12 or less carbon atoms and, further, may be substituted; and M represents a cation.

DETAILED DESCRIPTION OF THE INVENTION

Suitable substituted or unsubstituted alkyl groups represented by R in the above general formula (I) include straight chain, branched chain and cyclic alkyl groups. Suitable examples of substituents for such alkyl groups include a hydroxyl group, a halogen atom, a sulfo group, a carboxyl group, an amino group, an alkyloxy group, an alkylthio group, an aryloxy group, an arylthio group, a sulfonamido group, an alkylamido group, an aldehyde group, a vinyl group and so on. Preferred examples of alkyl groups represented by R include a methyl group, an ethyl group, a methoxyethyl group, an n-propyl group, an isopropyl group, an allyl group, an n-butyl group, a t-butyl group, an isobutyl group, a t-amyl group, an n-octyl group, a t-octyl group and the like.

Suitable substituted or unsubstituted alkoxy groups represented by R in the foregoing general formula (I) may be either straight or branched chain alkoxy groups (for example, $C_1$–$C_8$ alkoxy groups such as methoxy, ethoxy, n-butoxy, t-butoxy, octyloxy, etc.), and suitable examples of substituent groups for the alkoxy group include alkoxy group (especially a methoxy group, an ethoxy group and a butoxy group), phenylhydroxy groups, halogen atoms (especially a chlorine atom), amino groups and so on.

Specific examples of aromatic groups represented by R in the foregoing general formula (I) include unsubstituted and substituted phenyl groups, and suitable substituents thereof are alkyl groups (especially a methyl group), alkoxy groups (especially a methoxy group), and halogen atoms (especially a chlorine atom).

Suitable substituted or unsubstituted alkylthio groups represented by R in the foregoing general formula (I) may be either straight or branched chain alkylthio groups (for example, $C_1$–$C_8$ alkylthio groups such as methylthio, ethylthio, n-butylthio, t-butylthio, octylthio, etc.), and suitable substituents thereof include alkoxy groups (especially a methoxy group).

Suitable examples of M in the foregoing general formula (I) include a hydrogen ion, alkali metal ions, alkaline earth metal ions, ammonium ion ($NH_4^{\oplus}$) and other cations.

The compound represented by the general formula (I) achieves the object of the present invention when employed in an amount of about 0.02 to 2 g, preferably 0.05 to 1 g, per 1 kg of the alkaline processing solution.

Specific examples of compounds represented by the general formula (I) which can be employed in the present invention are illustrated below.

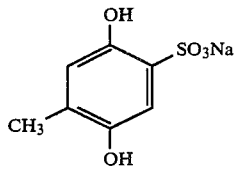

Compound (1)

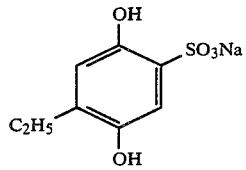

Compound (2)

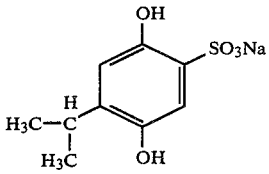

Compound (3)

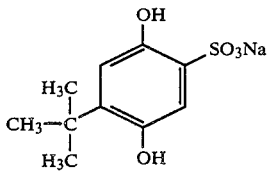

Compound (4)

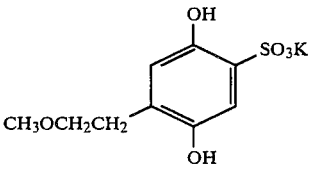

Compound (5)

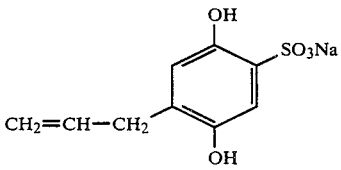

Compound (6)

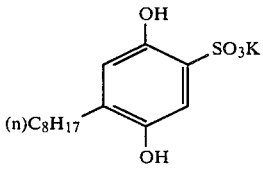

Compound (7)

-continued

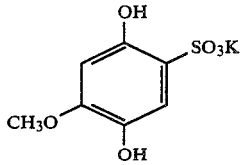

Compound (8)

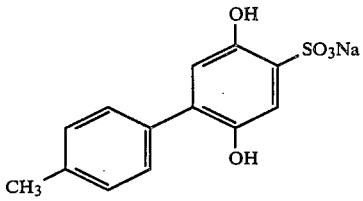

Compound (9)

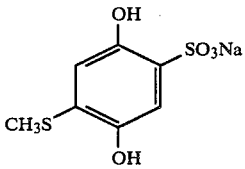

Compound (10)

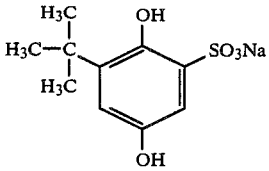

Compound (11)

The compounds of the present invention can be synthesized using the method described in *Bull. Soc. Chim. Belges,* Vol. 74, pp. 397–406 (1965).

The synthesis of Compound (4) is illustrated below as a typical synthesis example.

t-Butylhydroquinone and ethylene chloride were mixed in amounts of 13.4 g and 300 ml, respectively, and stirred at room temperature (about 20°–30° C.). Thereto, 6.5 g of sulfur trioxide was added over a 10 minute period. The reaction was continued for 2 hours, and crystals thus precipitated were filtered off. The crystals were stirred with 200 ml of water, and the resulting insoluble matter was filtered out. To the filtrate was added 50 g of sodium chloride and thereby salting out was achieved. The thus-precipitated crystals were filtered off. The crystals were stirred with 120 ml of ethanol for 1 hour and then sodium chloride was filtered out therefrom. The filtrate was concentrated to 20 ml to yield Compound (4) as a precipitate. The thus-precipitated Compound (4) was filtered off. Yield: 10.1 g (48.9%).

A silver halide developing agent to be used in the present invention is generally present in an alkaline processing solution, while it can be incorporated in advance in at least one layer of the light-sensitive element. Further, the silver halide developing agent can also be present in both the alkaline processing solution and the light-sensitive element. Where the silver halide developing agent is previously incorporated in the light-sensitive element, the silver halide developing agent may be present in the form of precursor which can be converted into the developing agent by decomposition under alkaline conditions.

Suitable silver halide developing agents which can be used herein include any kind of silver halide developing agents, provided that the oxidation products thereof can undergo a cross-oxidation reaction with DRR compounds. Specific examples of suitable developing agents include 3-pyrazolidinones, such as 1-phenyl-3-pyrazolidinone, 4,4-dimethyl-1-phenyl-3-pyrazolidinone, 4-hydroxymethyl-4-methyl-1-phenyl-3-pyrazolidinone, 4-hydroxymethyl-4-methyl-1-tolyl-3-pyrazolidinone, 4-hydroxymethyl-4-methyl-1-(4'-methoxy)-3-pyrazolidinone, 4,4-bis(hydroxymethyl)-1-phenyl-3-pyrazolidinone, 4,4-bis(hydroxymethyl)-1-tolyl-3-pyrazolidinone, 4,4-bis(hydroxymethyl)-1-(4'-methoxy)-3-pyrazolidinone, 4,4-dimethyl-1-tolyl-3-pyrazolidinone, 1,5-diphenyl-3-pyrazolidinone, etc.; aminophenols, such as p-aminophenol, p-methylaminophenol, p-dimethylaminophenol, p-diethylaminophenol, p-dibutylaminophenol, p-piperidinoaminophenol, 4-dimethylamino-2,6-dimethoxyphenol, etc.; phenylenediamines, such as N-methyl-p-phenylenediamine, N,N-dimethyl-p-phenylenediamine, N,N-diethyl-p-phenylenediamine, N,N,N',N'-tetramethyl-p-phenylenediamine, 4-diethylamino-2,6-dimethoxyaniline, etc.; and reductones, such as piperidinohexose reductone, pyrrolidinohexose reductone, etc. These developing agents may be used alone or as a combination of two or more thereof. Among these silver halide developing agents, 3-pyrazolidinones are preferred. An amount of the silver halide developing agent is preferably from 1 g to 20 g per liter of the processing solution.

Alkalinity-providing substances prevent in the alkaline processing solution employed in the present invention include hydroxides of alkali metals and other like metals, e.g., sodium hydroxide, potassium hydroxide, rubidium hydroxide, cesium hydroxide, etc.

In addition, sodium carbonate and amines such as diethylamine can be employed. The alkaline processing solution is adjusted to preferably a pH of 11 or above due to the presence of these alkalinity-providing substances therein.

It is preferable to add a thickener as described below to the alkaline processing solution used in the present invention. Suitable examples of thickeners include ethers which are inert in an alkaline solution, such as hydroxyethyl cellulose, alkali metal salts of carboxymethyl cellulose (e.g., sodium carboxymethyl cellulose), etc. The amount of such a thickener in the alkaline processing solution depends on the kind, the degree of polymerization and other properties thereof. In general, it is advantageous for 1 to 10 wt% of the thickener to be present in the processing solution. A suitable viscosity for the processing solution is up to about 100 to 250,000 cps. Accordingly, the processing solution can optionally contain other thickeners as described in *Research Disclosure,* No. 15162 (November, 1976), e.g., polysaccharide gums like guar gums, xanthanes, and algins in addition to the above-described thickeners.

The alkaline processing solution used in the present invention contains desirably an opacifying agent. Suitable opacifying agents which can be used are, e.g., carbon black, titanium dioxide and other light-absorbing dyes such as indicator dyes and the like.

Further, various kinds of compounds can be incorporated in the photographic element of the present invention for various purposes.

Specifically, the following additives can be incorporated in the photographic element of the present invention for the purpose of increasing the density of the transferred image. For example, suitable additives include aromatic alcohols, such as benzyl alcohol, p-xylene-$\alpha,\alpha'$-diol, etc., as described in U.S. Pat. No. 3,846,129; and aliphatic or alicyclic glycols, and saturated aliphatic or alicyclic aminoalcohols, such as 1,4-cyclohexanedimethanol, 1,6-hexanediol, 3-amino-1-propanol, 2-amino-1-propanol, 5-amino-1-pentanol, 6-amino-1-hexanol, 2-amino-2-methyl-1-propanol, etc., as described in U.S. Pat. No. 4,030,920.

The photographic element of the present invention can contain compounds as described in U.S. Pat. No. 3,942,987 for the purpose of preventing pimple-like deformation from occurring after the substantial conclusion of the development. Specific examples of such compounds include fluorides or oxalates of alkali metals, barium salts and so on.

The photographic element of the present invention may further contain the compounds as described in U.S. Pat. No. 2,497,917. Specific examples of such compounds include 5-methylbenzotriazole, 5,6-dichlorobenzotriazole, 6-nitrobenzimidazole, histidine and so on.

In many cases, a pigment such as carbon black or titanium dioxide is dispersed homogeneously into the alkaline processing solution employed in the present invention. Known dispersing aids and surface active agents can be used. For example, alkali metal salts of compounds such as polyacrylic acid, naphthalenesulfonic acid, the polymer of naphthalenesulfonic acid and formaldehyde, polystyrenesulfonic acid, and the like can be used as the above-described agents. Especially useful carbon black dispersions can be prepared using the compounds and the method described in Japanese Patent Application No. 200862/82 (which corresponds to U.S. patent application Ser. No. 552,188, filed on Nov. 15, 1983, and West German Patent Application No. P 33 41 394.0, filed on Nov. 15, 1983).

In order to convert various impurities present in an alkaline processing solution so that they are substantially harmless to silver halide emulsions, compounds as described below may be added to the processing solution. Specific examples of such compounds include metal salts, e.g., silver nitrate, silver oxide, lead oxide, tin oxide, cadmium oxide, zinc nitrate, mercury oxide, etc.

Monoalkylhydroquinones thus far known as a competitive developer, and the hydroquinones described in Japanese Patent Application (OPI) No. 51741/81 suffer from the defects that they accelerate the deterioration of properties of the alkaline processing solution with the lapse of time, and cause "uneven development-processing (uneven density of image dye)", as described hereinbefore.

Although the mechanisms of the above-described phenomena are still not elucidated, the following assumptions can be made respectively. As for the former phenomenon, it can be assumed that the above-described hydroquinones are oxidized during the preparation of the alkaline processing solution or storage thereof, and the resulting oxidation products or the reaction products of the oxidation products with alkali or other components in the processing solution adversely affect the silver developability by the alkaline processing solution and thereby a deterioration with the lapse of time occurs. As for the generation of mottle, it can be assumed that local oxidation of the hydroquinone derivatives is caused by oxygen or the like which is entrapped in the processing solution at the time of development-processing, which is responsible for the generation of unevenness in silver development and, in turn, for "uneven development-processing". On the other hand, the compounds of the present invention are assumed to be difficult to oxidize compared with conventional hydroquinones; or even if they are oxidized, the oxidation products thereof or the subsequent reaction products are very hydrophilic due to the presence of $-SO_3^{\ominus}$ group and, consequently, behave comparatively non-adsorptively toward silver halides. Therefore, they do not have adverse influences upon silver development.

The light-sensitive silver halide emulsion employed in the present invention can be a hydrophilic colloidal dispersion of silver chloride, silver bromide, silver chlorobromide, silver iodobromide, silver chloroiodobromide or a mixture of two or more thereof. A preferred halide composition of the silver halide, although it is selected depending upon the end-use purpose of the photosensitive material and the processing condition thereof, is silver bromide, silver iodobromide or silver chloroiodobromide which contains 10 mol% or less iodide, 30 mol% or less chloride and the remainder bromide.

Either negative emulsions which form a latent image at the surface of the grains or direct reversal emulsions can be used in the present invention. Suitable direct reversal emulsions include emulsions of the kind which form a latent image predominantly inside the grains, and previously fogged direct reversal emulsions.

Direct reversal silver halide emulsions of the kind which form a latent image predominantly inside the grains can be employed to advantage in the present invention. Specific examples of emulsions of this kind include conversion type emulsions, core/shell type emulsions, emulsions having a foreign metal within the grains, and so on, as described in, e.g., U.S. Pat. Nos. 2,592,250, 3,206,313, 3,447,927, 3,761,276 and 3,935,014 and so on.

Typical examples of nucleating agents for the above-described emulsions include hydrazines described in U.S. Pat. Nos. 2,588,982 and 2,563,785; hydrazides and hydrazones described in U.S. Pat. No. 3,227,552; quaternary salt compounds described in British Pat. No. 1,283,835, Japanese Patent Publication No. 38164/74, and U.S. Pat. Nos. 4,115,122, 3,734,738, 3,719,494 and 3,615,615; sensitizing dyes having a nucleating substituent group in each individual dye molecule, as described in U.S. Pat. No. 3,718,470; and acylhydrazine compounds with a thiourea linkage described in U.S. Pat. Nos. 4,030,925, 4,031,127, 4,245,037, 4,255,511, 4,266,013 and 4,276,364 and so on.

DRR compounds which can be used preferably in the present invention are non-diffusible under an alkaline processing condition, and can be represented by the following general formula (II):

(Ballast)-(Link)-(Dye) (II)

wherein (Ballast) represents a ballast group capable of rendering this compound non-diffusible under an alkaline processing condition, (Dye) represents a dye moiety or a precursor thereof which can move in a light-sensitive element under an alkaline processing condition, and (Link) represents a redox splittable group which has the capability of bond cleavage due to the oxidation accompanying development, or on the contrary to suppress cleavage.

DRR compounds which can be most advantageously used in the present invention are negative working DRR compounds, and specific examples thereof are described in Japanese Patent Application (OPI) Nos. 33826/73, 54021/79, 113624/76 and 71072/81 and so on.

Specific examples of the moiety, (Ballast)-(Link)-, which can release a diffusible dye corresponding to the development of silver halide under alkaline conditions include the following moieties:

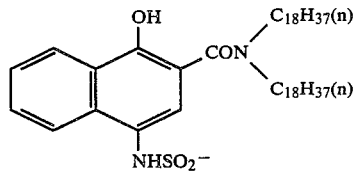

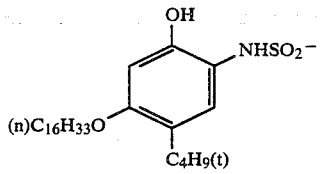

Examples of other DRR compounds which can be used are compounds having a positive working redox mother nucleus, as described in, e.g., Japanese Patent Application (OPI) Nos. 110828/78, 110827/78, 111628/74, 4819/77, 63618/76, 130927/79 and 164342/81 and so on. Among these compounds, those having a redox carrier moiety represented by the following general formula (III) are particularly desirable:

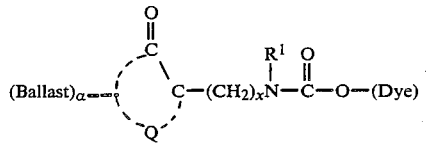

(III)

wherein Ballast has the same meaning as in the general formula (II); Q represents a quinone nucleus (including those with various kinds of substituent groups); x represents an integer of 1 or 2; $R^1$ represents an unsubstituted or substituted alkyl group containing 1 to about 40 carbon atoms, or an unsubstituted or substituted aryl group containing 6 to 40 carbon atoms; and $\alpha$ is 0 or 1, but $\alpha$ is 1 when $R^1$ is a group containing 8 or less carbon atoms.

Dyes released from DRR compounds may be either known dyes or dye precursors which can be converted to corresponding dyes in the photographic processing step or at the stage of additional processings. Further, the final image dye may be combined with a metallic ion to form a chelate. Representative dyes include azo dyes, azomethine dyes, anthraquinone dyes, phthalocyanine chelates of metals, and metal-free phthalocyanine dyes. Among these dyes, cyan, magenta and yellow dyes of the azo type are particularly useful.

Specific examples of yellow DRR compounds are described in Japanese Patent Publication No. 2618/74, U.S. Pat. No. 3,309,199, Japanese Patent Publication No. 12140/82, Japanese Patent Application (OPI) Nos. 114930/76, 111344/79, 16130/81, 71072/81, 79031/79, 64036/78 and 23527/79, U.S. Pat. Nos. 4,148,641 and 4,148,643, and *Research Disclosure,* 17630 (1978) and 16475 (1977).

Specific examples of magenta DRR compounds are described in U.S. Pat. No. 3,453,107, Japanese Patent Publication No. 43950/71 and Japanese Patent Application (OPI). No. 106727/77, U.S. Pat. Nos. 3,932,380, 3,931,144 and 3,932,308, and Japanese Patent Application (OPI) Nos. 115528/75, 106727/77, 23628/78, 65034/79, 36804/80, 161332/79, 4028/80, 73057/81, 71060/81, 134/80 and 35533/78 and U.S. Pat. Nos. 4,207,104, 4,287,292, 4,357,410 and 4,357,412.

Specific examples of cyan DRR compounds are described in Japanese Patent Publication No. 32130/73, Japanese Patent Application (OPI) Nos. 8827/77, 126331/74, 109928/76, 99431/79, 149328/78, 8827/77, 47823/78, 143323/78, 99431/79, 71061/81, 64035/78 and 121125/79, U.S. Pat. Nos. 4,142,891, 4,195,994, 4,147,544 and 4,148,642, and European Pat. Nos. 53,037 and 53,040, and *Research Disclosure,* 17630 (1978), 16475 (1975) and 16475 (1977).

In addition, DRR compounds having a dye moiety whose light-absorption band is temporarily shifted in a light-sensitive element can be used as a kind of dye precursor in the present invention, and specific examples of such compounds are described in Japanese Patent Application (OPI) Nos. 53330/80 and 53329/80, U.S. Pat. Nos. 3,336,287, 3,579,334 and 3,982,946, and British Pat. No. 1,467,317.

A suitable amount of the DRR compounds as described above ranges from $1\times10^{-4}$ to $1\times10^{-2}$ mol/m$^2$, preferably from $2\times10^{-4}$ to $2\times10^{-3}$ mol/m$^2$.

In order to reproduce natural color by the subtractive color process, a light-sensitive material comprising at least two sets of combinations of an emulsion having selective spectral sensitivity within a certain wavelength region with a DRR compound having selective spectral absorption within the same wavelength region as described above is employed.

In particular, a light-sensitive element comprising a combination of a blue-sensitive silver halide emulsion with a yellow DRR compound, a combination of a green-sensitive silver halide emulsion with a magenta DRR compound, and a combination of a red-sensitive silver halide emulsion with a cyan DRR compound is advantageously employed. These combined units of an emulsion and a DRR compound may be coated in a multilayer form in a face-to-face relationship to one another in a light-sensitive material, or may be coated in a single layer in the form of separate grains (the DRR compound and the silver halide combined as a unit are present in the same grain) and then mixed with one another. The image-receiving element (involving at least a mordanting layer) which can be used for the photographic element of the present invention includes a neutralizing layer, a neutralization rate controlling layer (or a timing layer), a reflecting layer, a light-intercepting layer, a cover sheet and so on. For example, those described in Japanese Patent Application (OPI) No. 64533/77 and so on can be applied thereto.

Suitable examples of polymeric mordants which can be employed in the mordanting layer include polymers containing secondary amino groups, polymers containing tertiary amino groups, polymers having nitrogen-containing heterocyclic groups, polymers containing such groups as described above in their respective quaternary cationic form, and the like, each of which has a molecular weight of preferably about 5,000 or more, and particularly preferably 10,000 or more.

A processing solution (which is a main component of the processing element) used in the present invention is desirably retained in a rupturable container as described in U.S. Pat. Nos. 2,543,181, 2,643,886, 2,653,732, 2,723,051, 3,056,491, 3,056,492 and 3,152,515 and so on.

Where the photographic element of the present invention has the form of a photographic film unit, that is, a film unit which is so constructed that after imagewise exposing the photographic processing can be effected by passing the imagewise exposed film unit through a pair of juxtaposed pressure-applying means, the following elements are present:

(1) Support,
(2) Light-sensitive element as described above,
(3) Image-receiving element as described above, and
(4) Processing element as described above.

The most advantageous embodiment of integral type film units for the present invention is disclosed in Belgian Pat. No. 757,959. According to this embodiment, the film unit comprises a transparent support having thereon, in sequence, an image-receiving layer, a substantially opaque light-reflecting layer (e.g., a $TiO_2$ layer and a carbon black layer), and a single or plural light-sensitive layers as described above (light-sensitive element) and further thereon a transparent cover sheet is superposed in a face-to-face relation. A rupturable container which retains an alkaline processing solution containing an opacifying agent (e.g., carbon black) for intercepting light is arranged adjacent both the topmost layer of the above-described light-sensitive layer (or a protective layer) and the transparent cover sheet. After imagewise exposure from the side of the transparent cover sheet, such a film unit as described above is pulled from the camera. As a result of pulling the film unit from the camera, the container is ruptured by the pressure-applying means and the processing composition (containing an opacifying agent) is spread in a layer form between the light-sensitive layer and the cover sheet. Thereby, the light-sensitive layers are shielded from light because they are sandwiched between two light-intercepting layers. Accordingly, development proceeds in the light.

Neutralization of the alkali brought thereinto is advantageous in the film unit according to the above-described embodiment.

In particular, a neutralizing layer (and optionally, to provide a timing layer on the side where the processing solution is to be spread) is advantageously provided in the cover sheet.

Other useful integral unit type film units in which the photographic element of the present invention can be employed are described in U.S. Pat. Nos. 3,415,644, 3,415,645, 3,415,646, 3,647,487 and 3,635,707, and German Patent Application (OLS) 2,426,980.

In another preferred embodiment, an image-receiving element having a multilayer structure comprising a support, a neutralizing layer, a neutralizing rate controlling layer and a mordanting layer, arranged in this order, is superposed upon a light-sensitive element comprising a support which has thereon a single or plural light-sensitive layers so that it is brought into face-to-face contact with the light-sensitive layer, and the above-described alkaline processing solution is also spread in a layer form between these two elements to effect development. After the substantial completion of the development, the image-receiving element may be either delaminated; or maintained as it is, as described in U.S. Pat. No. 3,415,645, provided that the support of the image-receiving layer is transparent and that a reflecting layer is provided between the image-receiving layer and the light-sensitive layer and thereby the image in untouched condition can be seen.

In the film unit of such a type that the image-receiving element is delaminated from the light-sensitive element after the transfer procedure, the neutralizing layer and the neutralization rate controlling layer can be omitted as well.

The following examples are given to illustrate the present invention in greater detail. Unless otherwise indicated, all parts, percents, ratios and the like are by weight.

EXAMPLE 1

On a transparent polyethylene terephthalate film support were coated the layers described below in the order listed to prepare a light-sensitive material:

(1) Mordanting layer containing 3.0 g/m$^2$ of copoly(styrene-N-vinylbenzyl)-N,N,N-trihexylammonium chloride) and 3.0 g/m$^2$ of gelatin.

(2) Light-reflecting layer containing 20 g/m$^2$ of titanium dioxide and 2.0 g/m$^2$ of gelatin.

(3) Light-intercepting layer containing 3.0 g/m$^2$ of carbon black and 2.0 g/m$^2$ of gelatin.

(4) Layer containing 0.44 g/m of a cyan dye-releasing redox compound having the following structure:

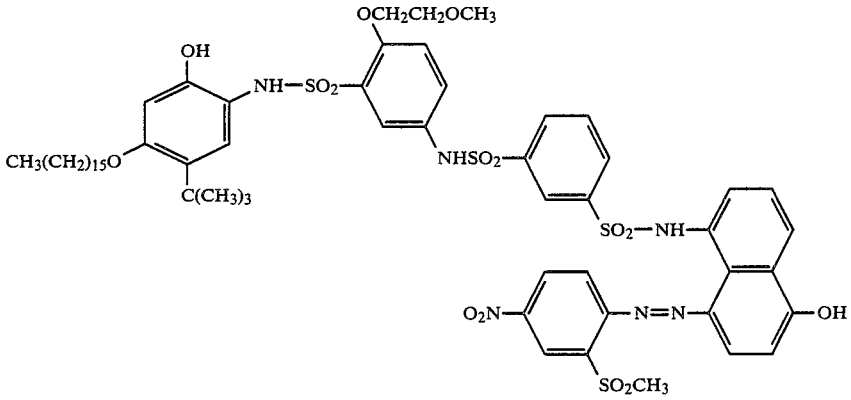

0.09 g/m$^2$ of tricyclohexyl phosphate and 0.8 g/m$^2$ of gelatin.

(5) Layer containing a red-sensitive internal latent image type direct reversal silver bromide emulsion (containing 1.03 g/m$^2$ of silver), 1.2 g/m$^2$ of gelatin, 0.05 mg/m$^2$ of nucleating agent having the following structural formula:

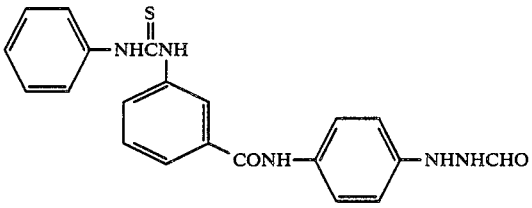

and 0.13 g/m$^2$ of sodium salt of 2-sulfo-5-n-pentadecylhydroquinone.

(6) Color-mixing preventing layer containing 0.8 g/m$^2$ of gelatin, 1.0 g/m$^2$ of 2,5-di-t-pentadecylhydroquinone and 1.0 g/m$^2$ of polymethylmethacrylate.

(7) Layer containing 0.21 g/m$^2$ of a magenta dye-releasing redox compound having the structural formula I shown below:

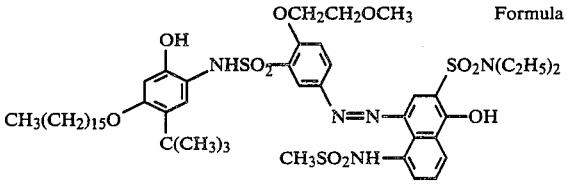

0.11 g/m$^2$ of a magenta dye-releasing redox compound having the structural formula II shown below:

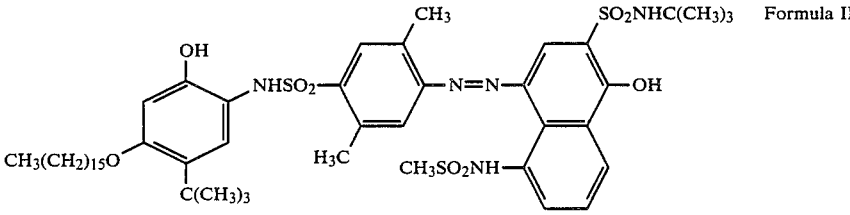

0.08 g/m$^2$ of tricyclohexyl phosphate and 0.9 g/m$^2$ of gelatin.

(8) Layer containing a green-sensitive internal latent image type direct reversal silver bromide emulsion (containing 0.82 g/m$^2$ of silver), 0.9 g/m$^2$ of gelatin, 0.03 mg/m$^2$ of the same nucleating agent as described for layer (5) and 0.08 g/m$^2$ of the sodium salt of 2-sulfo-5-n-pentadecylhydroquinone.

(9) Same as layer (6).

(10) Layer containing 0.53 g/m² of a yellow dye-releasing redox compound having the structural formula shown below:

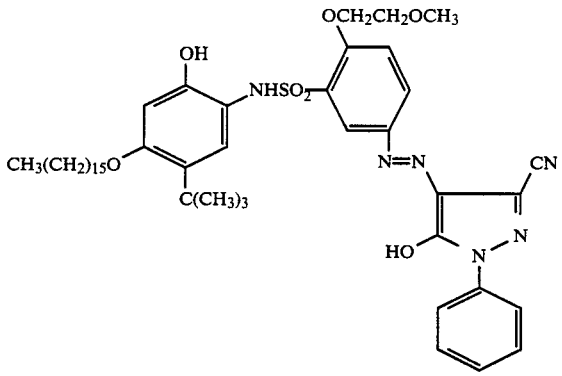

0.13 g/m² of tricyclohexyl phosphate and 0.7 g/m² of gelatin.

(11) Layer containing a blue-sensitive internal latent image type direct reversal silver bromide emulsion (containing 1.09 g/m² of silver), 1.1 g/m² of gelatin, 0.04 mg/m² of the same nucleating agent as in layer (5) and 0.07 g/m² of sodium salt of 2-sulfo-5-n-pentadecylhydroquinone.

(12) Layer containing 1.0 g/m² of gelatin.

A cover sheet was prepared by coating on a transparent polyethylene terephthalate film support the following layers in the order listed below:

(1') Layer containing 22 g/m² of acrylic acid-butyl acrylate (80:20 by weight) copolymer and 0.44 g/m² of 1,4-bis(2,3-epoxypropoxy)butane.

(2') Layer containing 3.8 g/m² of acetylcellulose (containing acetyl group in such a fraction that 100 g of acetylcellulose is hydrolyzed to produce 39.4 g of acetyl group), 0.2 g/m² of styrene-maleic anhydride (60:40 by weight) copolymer (having a molecular weight of about 50,000) and 0.115 g/m² of 5-(β-cyanoethylthio)-1-phenyltetrazole.

(3') Layer containing 2.5 g/m² of vinylidene chloride-methyl acrylate-acrylic acid (85:12:3 by weight) copolymer latex and 0.05 g/m² of polymethyl methacrylate latex (having a particle size of 1 to 3 μm).

The above-described light-sensitive material was imagewise exposed to light using tungsten light of 2,854° K. and converting it to light of 4,800° K. by passing it through a Davis-Gibson filter, through a continuous wedge (with a maximum exposure of 10 CMS).

The thus-exposed film was developed with each of the processing solutions having the following compositions respectively.

| Processing Composition A: | |
|---|---|
| 1-Phenyl-4-hydroxymethyl-4-methyl-3-pyrazolidinone | 12 g |
| Methylhydroquinone | 0.3 g |
| 5-Methylbenzotriazole | 3.5 g |
| Sodium Sulfite (anhydrous) | 0.2 g |
| Sodium Salt of Carboxymethyl Cellulose | 43 g |
| Potassium Hydroxide | 56 g |
| Benzyl Alcohol | 1.5 ml |
| Carbon Black | 150 g |
| Water to make total weight | 1 kg |

Processing Composition B

The same composition as Composition A except that 0.64 g of Compound (4) was present therein in place of 0.3 g of methylhydroquinone.

Processing Composition C

The same composition as Composition A except that methylhydroquinone was not present.

Processing Composition D

The same composition as Composition A except that methylhydroquinone was removed therefrom and in place thereof, 0.40 g of t-butylhydroquinone was present.

Processing Composition E

The same composition as Composition A except that methylhydroquinone was not present and in place thereof, 0.24 g of hydroquinone was employed.

Processing Composition F

The same composition as Composition A except that methylhydroquinone was not present and in place thereof, 0.40 g of 2-methyl-5-isopropylhydroquinone described in Japanese Patent Application (OPI) No. 51741/81 was employed.

Each of the above-described Processing Compositions A to F was allowed to stand at 25° C. for 1 day and then spread in a layer 80μ thick between the imagewise exposed light-sensitive material and the foregoing cover sheet by passing them through a pair of juxtaposed pressure-applying means.

24 hours after the processing composition had been spread, observations of unevenness of image density obtained and density measurements were carried out.

TABLE 1

| Processing | $D_{max}$ | | | $D_{min}$ | | | γ Highlight | | | Density Unevenness | |
|---|---|---|---|---|---|---|---|---|---|---|---|
| Composition | Blue | Green | Red | Blue | Green | Red | Blue | Green | Red | Grade | Remarks |
| A | 1.79 | 2.16 | 2.15 | 0.23 | 0.24 | 0.32 | 57.0 | 52.0 | 51.0 | 3 | Comparison |
| B | 1.90 | 2.19 | 2.16 | 0.23 | 0.23 | 0.32 | 58.0 | 52.0 | 52.0 | 1 | Invention |
| C | 1.74 | 2.15 | 2.15 | 0.26 | 0.26 | 0.35 | 51.0 | 51.5 | 50.5 | 1 | Comparison |
| D | 1.92 | 2.19 | 2.17 | 0.23 | 0.23 | 0.32 | 58.5 | 52.5 | 52.0 | 3 | Comparison |
| E | 1.76 | 2.16 | 2.16 | 0.24 | 0.24 | 0.33 | 51.5 | 52.0 | 50.5 | 2 | Comparison |
| F | 1.97 | 2.21 | 2.18 | 0.22 | 0.23 | 0.32 | 62.0 | 54.0 | 53.0 | 5 | Comparison |

(Note 1) A value of γ highlight represents the difference, which is expressed in mm unit, between (1) the value of exposure (expressed on a logarithmic scale) required for obtaining a density of the minimum density (which is the density corresponding to the exposure of 1 CMS) + 0.1 and (2) the value of exposure (expressed on a logarithmic scale) required for obtaining the minimum density in the characteristic curve. Therein, 5 mm corresponds to 0.1 of exposure expressed in logarithmic terms.

(Note 2) Density unevenness is evaluated in five grades (grade 5 is the worst).

It can be seen from the results in Table 1 that:

(1) Processing Composition C, which contained no competitive developer, had substantially no density unevenness, but had high $D_{min}$ values than those of other processing compositions and showed lower $\gamma$ highlight value than that of Processing Composition B of the present invention, that is, it was inferior in gradation controlling capacity, (2) Processing Compositions A and D, although they had gradation controlling ability by comparing their $\gamma$ highlight values with those of Processing Composition C, had inferior density unevenness to Processing Composition B of the present invention, (3) Processing Composition E had inferior gradation controlling capacity ($\gamma$ highlight value) and density unevenness to Processing Composition B of the present invention, and (4) Processing Composition F had superior gradation controlling capacity because of its high $\gamma$ highlight values, but it had markedly inferior density unevenness to Processing Composition B of the present invention and, therefore, was not suitable for practical use.

Accordingly, the compounds of the present invention have proved to be remarkably superior to comparative compounds in sufficient $D_{min}$-lowering effect, gradation controlling capacity and have substantially no density unevenness.

EXAMPLE 2

In order to examine the deterioration of the processing compositions with the lapse of time, each of the alkaline Processing Compositions A to F was divided into two portions after preparation, and one proportion was kept for 3 months at a temperature of 5° C. and the other was kept for 3 months at a temperature of 45° C. Thereafter, the same light-sensitive material as described in Example 1 was processed with each of the thus-stored portions. The storage stability of the processing composition was evaluated by reference to the difference between the maximum yellow density attained using the processing composition kept at 5° C. ($D_{max}(F)$) and the maximum yellow density attained by using the processing composition kept at 45° C. ($D_{max}(T)$), that is, $\Delta D_{max} = D_{max}(F) - D_{max}(T)$.

TABLE 2

| | Processing Composition | | | | | |
|---|---|---|---|---|---|---|
| | A | B* | C | D | E | F |
| $\Delta D_{max}$ | 0.18 | 0.01 | 0.02 | 0.26 | 0.12 | 0.72 |

*Invention

As can be seen from the results in Table 2, Processing Composition B of the present invention caused a lowering of $D_{max}$ due to lapse of time to a considerably small extent, compared with processing compositions containing comparative compounds, that is to say, it had excellent storage stability.

While the invention has been described in detail and with reference to specific embodiments thereof, it will be apparent to one skilled in the art that various changes and modifications can be made therein without departing from the spirit and scope thereof.

What is claimed is:

1. A photographic element for a color diffusion transfer process comprising a support having thereon at least one silver halide emulsion layer and associated therewith a non-diffusible redox compound capable of releasing a diffusible dye or a precursor thereof as the result of treatment with an alkaline processing solution in the presence of a silver halide developing agent after exposure to light, an image-receiving element, and a processing element comprising a viscous alkaline processing solution, said alkaline processing solution containing a compound represented by the following general formula (I):

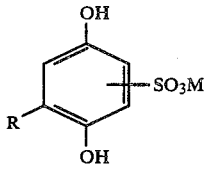

(I)

wherein R represents an alkyl group, an alkoxy group, an aromatic group or an alkylthio group, and each of these groups has 12 or less carbon atoms; and M represents a cation.

2. The photographic element of claim 1, wherein said silver halide emulsion is a direct reversal type silver halide emulsion.

3. The photographic element of claim 1, wherein R represents an alkyl group, an alkoxy group, or an aromatic group, and each of these groups has 1 to 8 carbon atoms.

4. The photographic element of claim 1, wherein said developing agent is 3-pyrazolidinone.

5. The photographic element of claim 1, wherein said processing solution is a viscous solution.

6. The photographic element of claim 1, wherein the alkyl group which may be a straight chain, branched chain or cyclic alkyl group is an unsubstituted or substituted alkyl group substituted with a hydroxy group, a halogen atom, a sulfo group, a carboxy group, an amino group, an alkyloxy group, an alkylthio group, an aryloxy group, an arylthio group, a sulfonamido group, an alkylamido group, an aldehydo group, or a vinyl group.

7. The photographic element of claim 6, wherein the alkyl group is a methyl group, an ethyl group, a methoxyethyl group, an n-propyl group, an isopropyl group, an allyl group, an n-butyl group, a t-butyl group, an iso-butyl group, a t-amyl group, an n-octyl group or a t-octyl group.

8. The photographic element of claim 1, wherein the compound of the general formula (I) is

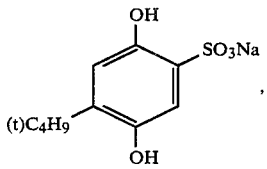

,

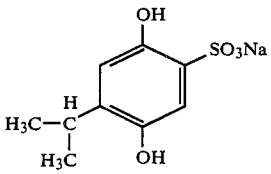

or

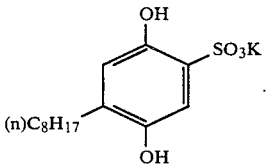

9. The photographic element of claim 1, wherein an amount of the compound of the general formula (I) is about 0.02 g to about 2 g per 1 kg of the processing solution.

10. The photographic element of claim 1, wherein the alkyl groups, alkoxy groups and alkylthio group represented by R each has from 1 to 8 carbon atoms.

11. The photographic element of claim 9, wherein the amount of the compound of the general formula (I) is about 0.05 to 1 g per 1 kg of the alkaline processing solution.

12. The photographic element of claim 1, which, due to the presence of the compound represented by general formula (I), shows less variation in $D_{max}$.

13. The photographic element of claim 1, which, due to the presence of the compound of general formula (I) exhibits low deterioration of the viscous alkaline processing solution with the passage of time.

* * * * *